US006092245A

United States Patent [19]

Jones

[11] Patent Number: 6,092,245

[45] Date of Patent: Jul. 25, 2000

[54] TOILET OPERATING LEVER FOR MULTIPLE APPLICATIONS

[76] Inventor: Butch Jones, 150 Highland View Dr., Birmingham, Ala. 35004

[21] Appl. No.: 09/468,007

[22] Filed: Dec. 20, 1999

[51] Int. Cl.[7] ..... E03D 5/09

[52] U.S. Cl. ..... 4/412; 4/405; 4/411

[58] Field of Search ..... 4/378, 405, 411–414, 4/407; 251/234, 294

[56] References Cited

U.S. PATENT DOCUMENTS 3,518,703 7/1970 Haldopoulos et al. ..... 4/412

*Primary Examiner*—Henry J. Recla
*Assistant Examiner*—Tuan Nguyen
*Attorney, Agent, or Firm*—Bullwinkel Partners, Ltd.

[57] ABSTRACT

A universal-fit, multiple-application molded thermoplastic operating lever for a flush toilet, the toilet having a buoyant flush valve flapper, tank ball or activating disk utilizing flexible connection chain for momentarily lifting the flush valve by manual operation of the lever, in which the lever incorporates a repeating sequence of different attachment points each suitable for a different toilet installation, each sequence including an intentionally weakened cut-off point which the installer can sever using ordinary hand tools, with the lever having a cruciform cross section and being made of molded alpha butyl styrene (ABS) so that the installer may bend the lever by hand up to about 45° from its as-molded shape.

5 Claims, 1 Drawing Sheet

FIG. 2
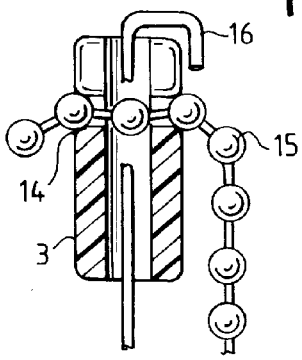
FIG. 1
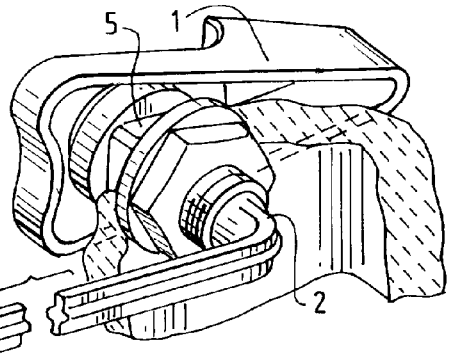
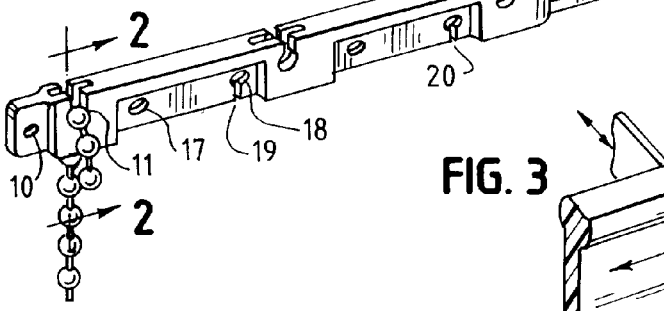
FIG. 3
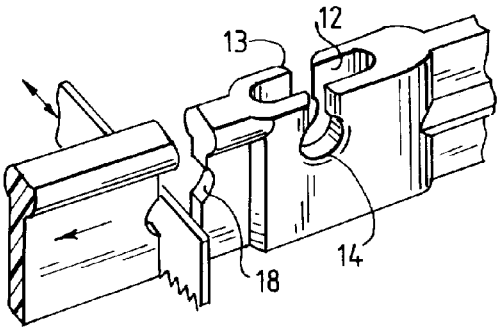
FIG. 4
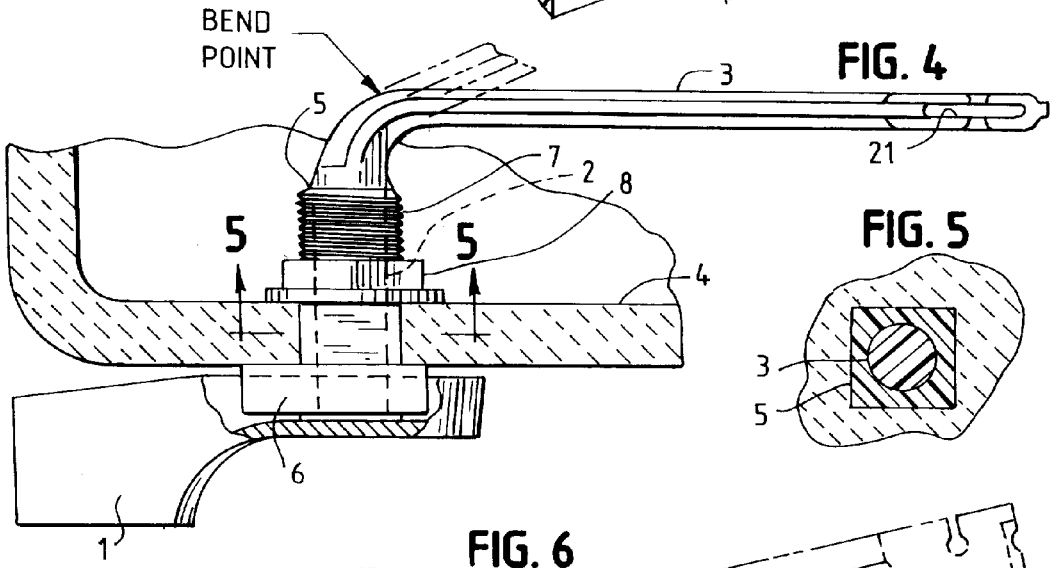
FIG. 5
FIG. 6
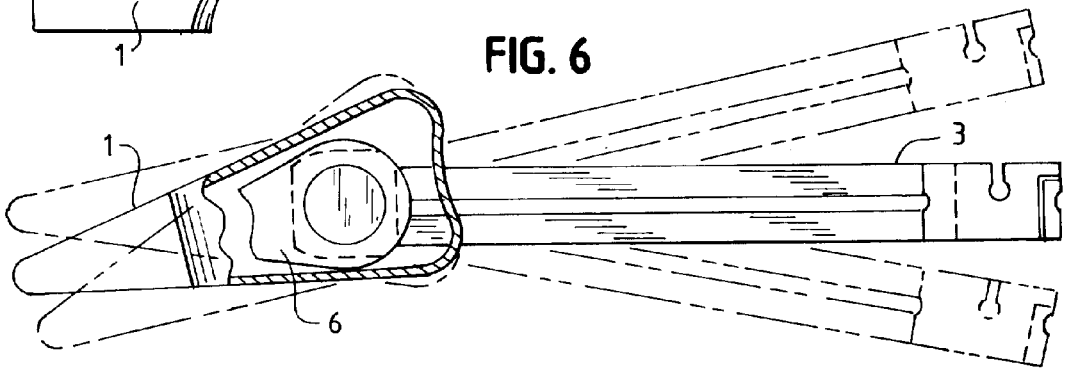

TOILET OPERATING LEVER FOR MULTIPLE APPLICATIONS

BACKGROUND OF THE INVENTION

This invention relates to an improved multiple-application or universal-fit operating lever for a flush toilet in which a single part may be used as a replacement in multiple applications covering a wide variety of flush toilets of different sizes and designs, and from different manufacturers.

Flush toilets in general, and particularly those intended for residential use, consist of a ceramic bowl emptying into a waste line, and a vertical tank or cabinet holding from about 1.6 to 5.0 gallons of water for flushing purposes. The tank is connected to a cold water supply pipe through a flush valve, which maintains the water level in the tank at a level which assures a sufficient volume of water is accumulated for flushing purposes.

At the bottom of the tank is a discharge opening leading to the toilet bowl. The opening is relatively large in diameter to present the least resistance to water flow, and is sealed by a buoyant valve, commonly either a ball shape or a hinged flapper received in a suitable valve seat formed by the periphery of the discharge opening, containing a hollow chamber for buoyancy. After a flushing, the valve falls into the discharge opening, sealing it. The flush valve opens, allowing the tank to fill with water. As the tank begins to fill, the water level covers the valve and opening, creating enough of a pressure across the discharge opening to overcome the natural buoyancy of the hollow chamber, thereby causing the valve to stay in place until the tank is filled with water.

To flush, the tank arm is manually lifted, which momentarily lifts the ball or flapper off of its seat in the discharge opening, breaking the pressure gradient across the discharge opening, and allowing the ball or flapper to rise with the buoyancy of the hollow chamber, and allowing the water to flow rapidly through the discharge opening, into the toilet bowl, and down into the sewer pipe.

The tank now being empty, the ball or flapper falls of its own weight into its seat in the discharge opening, and the force of the rising water admitted through the now-open float valve presses it down, where it is held in place by the rising water, and the cycle begins again.

SUMMARY OF THE INVENTION

A continuing problem for both plumbers and suppliers of replacement plumbing parts is that there are many different designs of flush toilets, made by many different manufacturers. While the essential principles of operation are the same, with a manually operated lever serving to lift the ball or flapper valve off its seat to initiate the flush cycle, the flush toilets that a plumber may find on the job may vary considerably in physical size and shape.

In particular, the manual flush handles used by flush toilets of this kind vary significantly in the manner in which they are mechanically linked to the flush valve (ball or flapper). There is generally an external operating handle 1 (FIG. 1) for the user to grasp and either press down, push in, or turn. The operating handle 1 is connected to a pivot 2 which is supported by a pivot fitting 5 which passes through an opening in the front or side wall of the flush tank 4. On the inside of the tank 4 the pivot 2 is connected to the base of the internal lever arm shaft 3 which operates the flush valve. The pivot fitting 5 has a square cross-section (FIG. 5) to prevent rotation, and includes a pawl 6 which fits within the handle 1 to limit the range of angular movement of the pivot 2.

In operation, the unequal lengths of the operating handle 1 and lever arm shaft 3 multiply a relatively short downward movement of the operating handle 1 into a greater upward movement at the end of the lever arm shaft 3, and this movement is utilized to lift the flush valve flapper or tank ball. When the handle 1 is pressed down, the lever arm shaft 3 is momentarily lifted from its stop, but when released, the weight and length of the lever arm shaft 3 cause the handle 1 to return to its original position.

The lever arm shaft 3 and flush valve flapper, tank ball or other activating unit are themselves connected by a flexible connecting means such as a flexible bead chain, a wire chain, brass or copper lift wires, or a non-corroding flexible rubber or plastic tether. This purpose of the flexible connecting means is to provide a lost-motion function which allows the buoyant flush valve to remain in an open position for the duration of the flush cycle until the flush tank 4 is completely empty, while still allowing the lever arm shaft 3 and flush handle 1 to return to their starting position immediately upon release of the handle 1.

It is therefore a principal feature of the invention to provide an improved flush valve operating lever adapted for use as a replacement or repair part, in which the same part may be installed in any one of several different kinds of toilet fixtures with little or no modification or adjustment. A related object is to provide such an operating lever with a plurality of receptacles or attachment points for receiving and retaining several different kinds of flush valve connecting means, such as wire hooks, ball chain, and rubber or plastic tethers.

It is a further object of the invention to provide a flush valve operating lever which, if not adapted to directly replace the original lever, may be easily modified in the field by trimming to the required length using simple tools. A related object is to provide such a lever made of non-corroding plastic which may be bent, by hand and without the use of tools, up to 45° from its original position to fit a particular installation, without breaking and with little or no loss of strength.

It has been found that a toilet tank 4 lever constructed according to the present invention may be successfully installed as a replacement in 98% of the toilet tanks in use today, including most or all of those manufactured by American Standard, Case/Briggs, Crane, Eljer, Gerber, Mansfield, Scovil and Universal Rundle (Sears).

BRIEF DESCRIPTION OF THE DRAWINGS

FIG. 1 is a perspective view of a toilet tank 4 operating lever according to the present invention;

FIG. 2 is a cross-section of a ball chain attachment point taken in the plane 2—2 of FIG. 1;

FIG. 3 is an enlarged perspective of a predetermined cut-off point of the arm of FIG. 1 being severed by a hacksaw;

FIG. 4 is a sectional plan view of the arm of FIG. 1 as installed in a toilet tank 4;

FIG. 5 is a cross-section of the arm in its pivot fitting 5 taking in the plane 5—5 of FIG. 4;

FIG. 6 is a side elevation of the arm of FIG. 1 showing its normal range of movement within its pivot fitting 5 for actuation of a flush valve (not shown).

DETAILED DESCRIPTION OF THE INVENTION

Turning to the drawings, there is shown in FIG. 1 a universal-fit operating lever or handle 1 for flush toilets constructed according to the present invention. The operating lever has a conventional manual operating handle 1 at one end which according to standard practice is pressed down to initiate the flush cycle. The operating handle 1 connects through a pivot 2 which penetrates a pivot opening in the toilet tank 4, which opening is located above the normal tank 4 water level after filling and when ready for use. The pivot 2 is integrally molded to the main body of the lever, to which the toilet operating mechanism is connected.

Within the pivot opening is a pivot fitting 5 of conventional design which receives and retains the pivot 2 for rotation within a limited range of angular movement. For this purpose the fitting 5 has a dog or pawl 6 which fits within the hollow handle 1. The fitting 5 is provided with threads 7 so that it may be secured to the toilet tank 4 with a suitable attachment nut 8. When thus secured, the pawl 6 serves as a stop or limit for rotational movement of the pivot 2 relative to the toilet tank 4, thereby constraining the angular movement of the pivot 2 to a range of about 45° from a first (rest) position at rest to a second (actuating) position. Preferably, the fitting 5 and attachment nut 8 are provided with left-hand threads 7 so that a forceful downward movement of the lever (see FIG. 6) will not tend to loosen the nut 8. When the lever is released, the weight of the lever arm shaft 3 causes it to return to its initial position. The arm shaft 3 has a maximum thickness no greater than the pivot so that it may be easily inserted through the toilet wall opening until the pivot 2 and fitting 5 are positioned for the nut 8 to be screwed on to fix the assembly in its proper position.

In accordance with the invention, along the shaft of the lever arm shaft 3 are a plurality of attachment points of different design adapted to receive and retain several different kinds of attachment means, commonly used by different toilet fixture manufacturers, to connect the lever arm shaft 3 to the tank ball, lift wire, flapper or other actuating unit along with the flush valve. In general, the attachment means of most toilet manufacturers consists of one of the following: a bead chain; a wire-link chain usually terminating in a wire clip or hook; a flexible copper or brass wire; or a rubber or plastic filament terminating in a loop or opening carrying a wire clip or hook.

Manufacturers such as American Standard produce toilet tanks requiring arm lengths of four, six and eight inches depending on the model, all of which have slotted connections to accommodate beaded chain or an arrow clip. Eljer requires arm lengths of four or six inches for their units. Mansfield requires slots for accepting the flush valve attachment means. Other manufacturers employ copper, brass or stainless steel chains, wires or rods, or flexible vinyl or rubber connection means. According to the invention, the improved arm disclosed in this specification will accept and function with all of these different actuation means.

In the illustrated embodiment, as best shown in FIG. 2, attachment points are provided in sequence for a wire chain ending in a hook or clip, a rubber or plastic filament ending in a similar hook or clip, and a bead chain. These different attachment points are grouped in clusters which sequentially repeat every two inches along the length of the arm, so that virtually any generally used connecting means can be attached at a suitable point along the length of the arm, either at or close to the ideal attachment point for the design of that particular toilet tank. Within each two-inch repeating segment of the lever are located means for attaching to several different types of flush valve connecting means, including beaded chain, linked chain with hooks, copper or brass wire with hooked ends, and flexible vinyl or rubber straps attaching to the flush valve flapper unit.

As best shown in FIG. 1, at the tip of the lever, preferably eight inches from the lever pivot axis (which distance will enable the lever to fit the products of a substantial number of toilet manufacturers), is a first attachment means, comprising a simple horizontal through-hole 10 adapted to receive and retain a hook, wire loop, or vinyl or rubber connecting strap.

Next in sequence proceeding from the tip of the lever is an attachment point 11 suitable to fit the products of a first substantial group of toilet manufacturers which utilize a beaded chain connecting means. This attachment point comprises a locally thickened area with a molded-in cavity 12 penetrated by an upward-opening keyhole-shaped lateral slot 13, as best shown in FIGS. 2 and 3. Preferably, the rounded outer lower portion of the keyhole 14 is countersunk slightly so that a selected connecting link of a bead chain 15 placed in it will slip into the countersunk opening and be retained there by the weight of the chain and (when under tension) the flush valve flapper.

To accommodate another common attachment means, the slot 13 is made to extend vertically through the lever so that a pre-formed wire hook 16 (FIG. 2) may be inserted from below, rotated 90°, and then dropped into position where it will similarly be retained in the keyhole slot 13.

Following the chain attachment point in the illustrated example are a second spaced horizontal through-hole 17, followed by a third hole 18, which in the illustrated example is positioned six inches from the lever pivot axis and marked with a molded-in index mark 19 to indicate its predetermined distance from the pivot axis. As a feature of the invention, the and sixth holes in the illustrated example also serve, as an intentionally weakened cut-off point, allowing the plumber to quickly and easily cut the lever to a predetermined six inch length which will fit the products of a second substantial group of toilet manufacturers. By providing the intentionally weakened cut-off point at a predetermined marked point along the lever, the installer is enabled to attach the flush valve, flapper, tank ball or actuating lever connecting means to the most suitable point along the arm, corresponding to the type of connection and lever arm shaft 3 length required for that particular installation, and then simply remove the unneeded portion of the arm at the weakened cut-off point by sawing, clipping with a wire cutter or pliers, or even manually bending it back and forth until it breaks off.

Preferably, the illustrated sequence (FIG. 1) is repeated to provide a second group of attachment points closer to the pivot axis. The first hole at the full eight-inch length of the lever is followed in spaced sequence by a bead chain receptacle, a second hole and then a third hole marked as a pre-measured six-inch cut-off point. The sequence is repeated by ending at another pre-measured cut-off point 20 four inches from the pivot axis, which will fit the toilet tank products of yet a third substantial group of manufacturers. In the illustrated preferred embodiment, the sequence starts again with another bead chain receptacle 21, and can be followed if desired by additional through-holes (not shown) disposed in spaced sequence approaching the pivot axis.

The lever arm shaft 3 of the present invention is made of molded thermoplastic with a generally cruciform cross-section between its pivot axis and the closest flush valve means attachment point 21 (see FIGS. 1 and 4). Such a cross-section facilitates bending by the plumber, if required, by keeping the lever arm shaft 3 in a fixed plane without rotating or becoming skewed. The remainder of the lever arm shaft 3 desirably has a "T" cross-section for strength and resistance to deformation from being loaded in a vertical direction by lifting a toilet flush valve flapper (not shown). This combination of shapes allows for ease of fabrication by injection molding as well as for strength and rigidity with a minimum of weight to conserve material.

The preferred thermoplastic material for this purpose is alpha-butyl styrene (ABS), and particularly the variety marketed under the brand name Cyclolac by Better Enterprise, Ltd. of Japan, with the preferred variety being GSM 450. This material is preferred because it has the quality of making the lever formable, by hand and without tools, through a wide range of angles, up to as much as 60° from its as-molded position (see FIG. 4). This material has a low restorative memory, which permits the installer to permanently adjust the position of the arm to function in flush tanks of widely varying physical shape. This particular material has the following physical characteristics, which are preferred for use with the application of the present invention:

| | |
|---|---|
| Specific gravity | 1.04 |
| Mold shrinkage | 0.5–0.8% |
| Tensile strength | 439 kg/cm$^2$ |
| Tensile elongation | Negligible |
| Flexural strength | 755 kg/cm$^2$ |
| Flexural modulus | 23 × 10$^3$ kg/cm$^2$ |
| Izod impact strength | 38 kg-cm/cm |
| Rockwell hardness | 105 |

According to another feature of the invention, the use of the particular molded plastic material described above permits the plumber or customer to adjust the lever arm shaft 3 by bending it in a horizontal plane (see FIG. 4) up to 30° from the pivot shaft axis, or about 60° from its original as-molded position 90° from the pivot shaft axis. In this way it can accommodate an even wider variety of different flush tanks, including modern low-height models in which the operating handle 1 is positioned either on the side of the tank 4, or on a rounded portion of the front of the tank. For some installations, the as-molded 90° angle will be suitable. In others, a bend of 45° from the as-molded condition is required to fit the particular installation. In an extreme case, where space inside the tank 4 is at a premium, it has been found that a bend of over 60° is required, in order to leave the arm at a permanent angle of 28° to the pivot axis of the pivot 2, or 62° from the as-molded position.

If it is required that the lever be bent into a shape different from the 90° as-molded angle from the pivot axis to fit the installation, the installer simply grasps the body of the lever at a point away from the intentionally weakened cut-off points, and bends the lever to the desired final position, and then past it about 10°, to allow for "memory" or spring-back. The particular ABS material of the invention accommodates this repositioning without breaking or loss of strength, and with a minimum of memory or spring-back which would tend to make the arm tend to return to its original shape immediately after deformation.

To perform an installation, the installer need only remove the old operating lever, insert the replacement part of the invention narrow-end-first through the pivot opening, slip the screw-on fitting 5 into place and secure it from the rear with its non-corrosive nut 8, and then deform or bend the operating lever to fit by hand to fit that particular installation.

For appearance and durability, the lever handle 1 is preferably plated with chrome or other decorative non-corroding metal. For assembly, the pivot 2 end of lever is inserted through the pivot fitting 5, and then inserted and retained by a press fit into a corresponding socket provided in the lever handle 1, with the result that the lever is firmly and non-removably secured to the handle 1 as best shown in FIG. 6.

According to the invention, to accommodate this wide variety of attachment means which the plumber may encounter in the field, the arm of the present invention is provided with a plurality of spaced attachment points of several types whereby several different kinds of flexible connecting means may be quickly and easily attached to the arm without modification and without the use of tools.

I claim as my invention:

1. In a flush toilet having a water tank, fill control means for maintaining a maximum water level in said tank, and a flush valve located at the bottom of said water tank and operable by mechanical linkage means having an upper end with means for connection to an operating lever, an improved multi-fit operating lever adapted for use with toilets of varying tank size and types of flush valve linkages comprising a manual operating handle, a lever arm molded integral with a pivot, said pivot being connected to said handle and turning about a pivot axis, means for securing said pivot and lever arm for rotatable operation in a toilet tank within an operating opening above said maximum water level, said lever arm having a base and a shaft, said base in an as-molded condition being at an angle of about 90° to said pivot axis, and said shaft being movable through a vertical arc of operation by manual rotation of said handle, said arm having a maximum thickness no larger than said pivot whereby said lever may be installed by insertion through said operating opening in said toilet tank, said arm having a plurality of attachment points and predetermined cut-off points spaced in repeating sequence along the length of said arm, the attachment points of each such sequence being adapted to receive and retain a variety of mechanical linkage means, with each sequence including at least (a) one horizontal lateral through-hole adapted to receive and retain a connecting means including a hook; and (b) an elongated cavity with an upward-opening lateral slot adapted to receive and retain, alternately, one bead in a linkage means including at its upper end a bead chain, or a hooked end of a wire connector extended upward through said cavity, and then rotated 90° to be received and retained by said lateral slot; and (c) a second through-hole to provide an intentionally weakened cut-off point at a predetermined location for shortening the length of the lever arm shaft to fit a particular installation.

2. The operating lever of claim 1 including a molded-in visual indicator means at said weakened cut-off point to indicate said predetermined location.

3. The operating lever of claim 1 in which the operating arm is made of injection-molded thermoplastic material.

4. The operating lever of claim 1 in which the lever arm is made of injection-molded thermoplastic material having low restorative memory, whereby said operating lever is selectively bendable at its junction with said pivot from about 90° from said pivot axis to a selected position within a range from about 90° and about 28° from said pivot axis without tending to return to its original position.

5.The operating lever of claim 4 in which the thermoplastic material consists of GSM 450 alpha butyl styrene.

* * * * *